US007452388B2

(12) United States Patent
Cook et al.

(10) Patent No.: US 7,452,388 B2
(45) **Date of Patent: *Nov. 18, 2008**

(54) COMPOSITIONS COMPRISING DIMERIC OR OLIGOMERIC FERROCENES

(75) Inventors: Stephen Leonard Cook, Chester (GB); Werner Kalischewski, Dorsten (DE); Gabriele Lohmann, Lünen (DE); Armin Marschewski, Haltern (DE)

(73) Assignee: Innospec Limited (GB)

( * ) Notice: Subject to any disclaimer, the term of this patent is extended or adjusted under 35 U.S.C. 154(b) by 267 days.

This patent is subject to a terminal disclaimer.

(21) Appl. No.: 10/363,124

(22) PCT Filed: Aug. 30, 2001

(86) PCT No.: PCT/GB01/03897

§ 371 (c)(1),
(2), (4) Date: Feb. 28, 2003

(87) PCT Pub. No.: WO02/18398

PCT Pub. Date: Mar. 7, 2002

(65) Prior Publication Data

US 2003/0188474 A1 Oct. 9, 2003

(30) Foreign Application Priority Data

Aug. 31, 2000 (DE) ..... 100 43 144

(51) Int. Cl.
*C10L 1/30* (2006.01)

(52) U.S. Cl. ..... 44/361; 44/358; 44/359

(58) Field of Classification Search ..... 44/361, 44/358, 359

See application file for complete search history.

(56) References Cited

U.S. PATENT DOCUMENTS 2,694,721 A * 11/1954 Weinmayr ..... 556/143
3,350,369 A * 10/1967 Rosenberg et al. ..... 526/238
3,673,232 A 6/1972 Talbot et al.
3,989,731 A 11/1976 Talbot
4,389,220 A * 6/1983 Kracklauer ..... 44/361
4,946,609 A 8/1990 Pruess et al.

FOREIGN PATENT DOCUMENTS

WO WO-99/36488 7/1999

OTHER PUBLICATIONS

"Regeneration of Particle Filters with Additives," H. Jungbluth, et al., Fuels 1999, Jan. 20-21, 1999.

* cited by examiner

*Primary Examiner*—Cephia D Toomer
(74) *Attorney, Agent, or Firm*—Fay Sharpe LLP

(57) ABSTRACT

The present invention relates to iron-organo compounds and the use of such compounds in the regeneration of particulate filter traps in combustion systems such as high-compression spontaneous ignition engines. The iron-organo compounds have the formula X-Y where X represents the group of formula

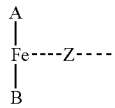

Y represents the formula

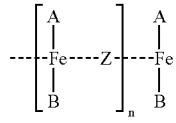

each A and B is independently an unsubstituted or substituted aromatic carbon ring or an unsubstituted or substituted aromatic heterocyclic ring; the or each Z is independently an unsubstituted or substituted divalent hydrocarbyl group; n is 0 or an integer of from 1 to 10.

39 Claims, No Drawings

COMPOSITIONS COMPRISING DIMERIC OR OLIGOMERIC FERROCENES

The present invention relates to compositions for use in the regeneration of particle filter systems connected at the exhaust side of combustion systems for fuel, especially high-compression spontaneous ignition engines.

The effect which iron-organic compounds, particularly ferrocene and derivatives thereof, have in promoting combustion is basically known both with respect to open flame combustion as well as combustion in engines. Furthermore, the prior art (e.g. Fuels 1999, $2^{nd}$ International Colloquium, Jan. 20-21, 1999 at Esslingen Technical Academy) discloses that diesel particle filters can be regenerated by additives in diesel fuel since the products of combustion to which the additive gives rise reduce the ignition temperature of the soot particles which have been filtered out in the diesel particle filter, these latter particles igniting and burning away.

Since iron-organic compounds, such as ferrocene, in solid form are not ideal for dosing to the fuel, solutions of the compounds are usually used. It is desirable, particularly when the combustion system is located on a vehicle, for the solutions containing the iron-organic compounds to be highly concentrated solutions so that the solution supply container can be as small as possible in size, or, rather, does not need to be frequently topped up. Furthermore, the solution should be stable at temperatures within a wide temperature range, especially within the range of −40° C. to +90° C., and also should not be too viscous at low temperatures in order to ensure good pumpability allowing accurate dosing.

In a highly aromatic solvent (PLUTOsol™ APF, supplied by Octel Deutschland GmbH) ferrocene itself has a solubility limit of 2.4% by weight at −40° C. corresponding to an iron content of 0.72% by weight. Solutions of iron-organic compounds containing 2.0% by weight, or more, of iron are sought.

It is an aim of the present invention to provide an iron-organic compound-containing composition suitable for use as an additive for fuels, typically liquid hydrocarbon fuels, wherein the composition has a high level of the iron-organic compound and hence of iron, particularly at low temperatures, and is stable across a wide temperature range, particularly is stable at low temperatures. By "stable across a wide temperature range" is meant that, over a wide temperature range (e.g. within the range of from −25° C. to +90° C., and preferably within the range of from −40° C. to +90° C.), particularly at low temperatures, the iron-organic compound-containing composition, preferably in the form of a solution in an organic solvent, remains pumpable and the iron-organic compound does not precipitate or phase-separate.

It has now been found that certain iron-organo compounds, for example bisferrocenylalkanes, may be used to produce compositions having a high level of the iron-organo compound, and hence of iron, and which are suitable for use as additives for fuels for use in the operation of combustion systems, preferably high-compression spontaneous ignition engines, having a particle filter in the exhaust system thereof. It has also been found that such compositions may have a high concentration of the iron-organo compound, and hence of iron, even at low temperatures and may be stable across a wide temperature range.

According to one aspect of the present invention there is provided a composition, which comprises:

i) one or more compound of formula (I):

X—Y (I)

where:

X has the structure represented by formula (II):

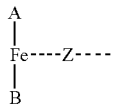

(II)

Y has the structure represented by formula (III):

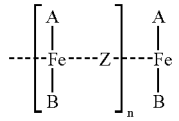

(III)

where:

each A and B is independently an unsubstituted or substituted aromatic carbon ring or an unsubstituted or substituted aromatic heterocyclic ring; the or each Z is independently an unsubstituted or substituted divalent hydrocarbyl group;

n is 0 or an integer of from 1 to 10.

In one embodiment of the present invention the compound(s) of formula (I) do not have the formula (IV):

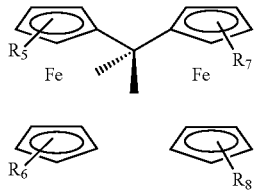

(IV)

where $R_5$ or $R_6$ and $R_7$ or $R_8$ are ethyl; and ii) a diluent or carrier; and wherein the one or more compound of formula (I) is present in an amount sufficient to provide at least 1 wt. % of iron, based on the weight of the composition.

It will be readily understood that the dashed lines shown in connection with the definition of the compound of formula (I) represent the bond from the unsubstituted or substituted divalent hydrocarbyl group to the respective A or B group and indicate that the bond can be either to the A or to the B group. Further, the bonds from the unsubstituted or substituted divalent hydrocarbyl group to the respective A or B groups may be from the same or a different atom of the unsubstituted or substituted divalent hydrocarbyl group, the former being a geminal compound and the latter being a non-geminal compound.

In the compound of formula (I) each A and B may, for example, independently be an unsubstituted or substituted aromatic carbon ring or an unsubstituted or substituted aromatic heterocyclic ring containing, in the ring, one or more heteroatoms selected from O, N and S. Preferably, each A and B is independently an unsubstituted or substituted aromatic carbon ring. More preferably, each A and B is an unsubstituted aromatic carbon ring.

In the compound of formula (I) each A and B may, for example, independently be an unsubstituted or substituted aromatic carbon ring or an unsubstituted or substituted heterocyclic ring, preferably an unsubstituted or substituted aromatic carbon ring, containing from 3 to 10 atoms in the ring. Preferably, each A and B is independently an unsubstituted or substituted aromatic carbon ring or an unsubstituted or substituted heterocyclic ring, preferably unsubstituted or substituted aromatic carbon ring, containing 3, 5 or 7 atoms in the ring. In the compounds of formula (I), the choice of the A and B rings associated with a particular Fe atom must be such that the 18-electron rule is obeyed.

In one embodiment of the present invention, either A or B associated with a particular Fe atom is an unsubstituted or substituted 3-membered aromatic carbon ring or an unsubstituted or substituted 3-membered aromatic heterocyclic ring, with the other of A and B associated with the same Fe atom being an unsubstituted or substituted 7-membered aromatic carbon ring or an unsubstituted or substituted 7-membered aromatic heterocyclic ring. Preferably, in this embodiment either A or B associated with a particular Fe atom is an unsubstituted or substituted 3-membered aromatic carbon ring, with the other of A and B associated with the same Fe atom being an unsubstituted or substituted 7-membered aromatic carbon ring. In an alternative embodiment A and B are each an unsubstituted or substituted, e.g. unsubstituted, aromatic carbon ring or an unsubstituted or substituted, e.g. unsubstituted, aromatic heterocyclic ring containing 5 atoms in the ring. Preferably, A and B are each an unsubstituted or substituted aromatic carbon ring containing 5 atoms in the ring. More preferably, A and B are each an unsubstituted aromatic carbon ring having five carbon atoms in the ring, i.e. a cyclopentadienyl ring.

In the compound of formula (I) one or more of A and/or one or more of B may, for example, be substituted with one or more substituent selected from alkyl, substituted alkyl, alkoxy, substituted alkoxy, aryl, substituted aryl, aralkyl and substituted aralkyl groups, preferably one or more substituent selected from alkyl, substituted alkyl, aryl and substituted aryl groups. More preferably, when one or more of A and/or one or more of B is substituted with one or more substituent, the substituent is an alkyl group. Other suitable substituents for the A and/or B groups include cyclic groups, e.g. cycloalkyl groups, and cyclic groups wherein two different carbon atoms on the A or B group form part of the cyclic ring of such cyclic group. When more than one of A and/or B is substituted, the substituent(s) may vary from ring to ring. Any substituent present on A and/or B should be inert under the reaction conditions employed in the preparation of the compounds of formula (I) and not give unfavourable interactions with the fuel or other additives employed in the fuel. Substituents meeting these conditions will be readily apparent to a person skilled in the art. Suitable substituents for the substituted alkyl and substituted alkoxy groups include halo, hydroxy, nitro, alkoxy, aryl, cyclic and ester groups, and suitable substituents for the substituted aryl and substituted aralkyl groups include halo, hydroxy, nitro, alkyl, alkoxy, cyclic and ester groups. In the case of substituted aralkyl groups, the substituent or substituents may be present on the aryl and/or the alkyl portion of the group. Particularly suitable substituents for A and/or B are alkyl groups with 1-4 C-atoms, for example, ethyl groups.

Preferably, in the compound of formula (I), A and B are the same.

As used herein, in connection with the present invention, the term "alkyl" or the alkyl portion of an alkoxy or aralkyl group, may be straight chain or branched chain.

The term "unsubstituted or substituted divalent hydrocarbyl group" as used herein means a group comprising at least C and H and which may, optionally, comprise one or more suitable substituents. A typical unsubstituted or substituted divalent hydrocarbyl group is an unsubstituted or substituted divalent hydrocarbon group. Here the term "hydrocarbon" means any one of an alkylene group, an alkenylene group, an alkynylene group, which groups may be linear, branched or cyclic, or a divalent aryl group. For example, the unsubstituted or substituted divalent hydrocarbon group may be an alkylene, branched alkylene or cycloalkylene group. The term hydrocarbon also includes those groups but wherein they have been optionally substituted. If the hydrocarbon is a branched structure having substituent(s) thereon, then the substitution may be on either the hydrocarbon backbone or on the branch; alternatively the substitutions may be on the hydrocarbon backbone and on the branch. A preferred unsubstituted or substituted divalent hydrocarbon group is an unsubstituted or substituted divalent alkylene group having at least one carbon atom in the alkylene linkage. More preferably, the unsubstituted or substituted divalent hydrocarbon group is an unsubstituted or substituted divalent alkylene group having from 1 to 10 carbon atoms in the alkylene linkage, for example, having at least 2 carbon atoms in the alkylene linkage or having one carbon atom in the alkylene linkage. If the divalent hydrocarbyl group comprises more than one C then those carbons need not necessarily be linked to each other. For example, at least two of the carbons may be linked via a suitable element or group. Thus, the divalent hydrocarbyl group may contain hetero atoms. Suitable hetero atoms will be apparent to those skilled in the art and include, for instance, sulphur, nitrogen and oxygen, for example, oxygen.

Examples of suitable substituents that may be present on one or more of the hydrocarbyl groups Z, include halo, a substituted or unsubstituted alkoxy group, nitro, a substituted or unsubstituted alkyl group, a substituted or unsubstituted aryl group, a substituted or unsubstituted aralkyl group, a substituted or unsubstituted alkaryl group, a substituted or unsubstituted cyclic group, and groups having the formula (V).

(V)

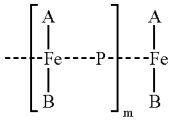

wherein: each A and B are as defined above; each P, when present, is independently an unsubstituted or substituted divalent hydrocarbyl group; and m is 0 or an integer of from 1 to 10. In addition to the possibility of the substituents being a cyclic group, a combination of substituents may form a cyclic group. In one embodiment, one or more of the hydrocarbyl groups, Z, comprises one or more substituted or unsubstituted aryl groups or one or more substituted or unsubstituted alkaryl groups as substituent(s). In another embodiment, one or more of the hydrocarbyl groups, Z, comprises, as substituent(s), one or more groups having the formula (V) in which A and B are cyclopentadienyl or alkylcyclopentadienyl rings. Any substituent present in the Z group should be inert under the reaction conditions employed in preparing the compounds of formula (I) and not give unfavourable interactions with the fuel or other additives employed in the fuel. Substituents meeting these conditions will be readily apparent to a person skilled in the art.

In one embodiment of the present invention Z, when n is 0, or one or more of the Z groups, when n is from 1 to 10, is substituted with one or more substituents selected from alkyl groups, substituted alkyl groups, aryl groups, substituted aryl groups, alkaryl groups, substituted alkaryl groups and groups having the formula (V) above, and is preferably substituted with one or more substituents selected from alkyl groups, substituted alkyl groups and groups having the formula (V) above. For example, when n is from 1 to 10, each of the Z groups may be substituted with one or more substituents selected from alkyl groups, substituted alkyl groups and groups having the formula (V) above.

Suitable substituents for the substituted alkyl and substituted alkoxy groups, that may be present in the Z group, include halo, hydroxy, nitro, alkoxy, cyclic and ester groups.

Suitable substituents for the substituted aryl, substituted aralkyl and substituted cyclic groups, that may be present in the Z group, include halo, hydroxy, nitro, alkyl, alkoxy, cyclic and ester groups, preferably alkyl groups. In the case of substituted aralkyl groups, the substituent or substituents may be present on the aryl and/or the alkyl portion of the group.

In another embodiment of the present invention, Z, when n is 0, or one or more of the Z groups, when n is from 1 to 10, is a group of formula (VI):

(VI)

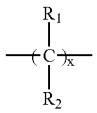

wherein each $R_1$ and $R_2$ is independently hydrogen, alkyl, substituted alkyl, alkoxy, substituted alkoxy, aryl, substituted aryl, aralkyl, substituted aralkyl, cyclic or substituted cyclic; and x is an integer of at least 1, e.g. an integer of from 1 to 10. Alternatively, $R_1$ and $R_2$, together with the carbon atom to which they are attached, may form a cyclic ring. In one embodiment x is an integer of at least 2 and, in another embodiment, x is 1.

In the group of formula (VI), each $R_1$ and $R_2$ may, for example, independently be hydrogen, $(C_1\text{-}C_6)$alkyl, substituted $(C_1\text{-}C_6)$alkyl, $(C_1\text{-}C_6)$alkoxy, substituted $(C_1\text{-}C_6)$alkoxy, $(C_6)$aryl, substituted $(C_6)$aryl, ar$(C_1\text{-}C_6)$alkyl or substituted ar$(C_1\text{-}C_6)$alkyl. Preferably, $R_1$ and $R_2$ are methyl.

A preferred group of formula (VI) is where x is 1 and $R_1$ and $R_2$ are both methyl.

$R_1$ or $R_2$, present in the group of formula (VI), should be inert under the reaction conditions employed in the preparation of the compounds of formula (I) and not give unfavourable interactions with the fuel or other additives employed in the fuel. $R_1$ or $R_2$ groups meeting these conditions will be readily apparent to a person skilled in the art. Suitable substituents for the substituted alkyl and substituted alkoxy groups, that may be present in the group of formula (VI), include halo, hydroxy, nitro, alkoxy, cyclic and ester groups. Suitable substituents for the substituted aryl, substituted aralkyl and substituted cyclic groups, that may be present in the group of formula (VI), include halo, hydroxy, nitro, alkyl, alkoxy, cyclic and ester groups, preferably alkyl groups. In the case of substituted aralkyl groups, the substituent or substituents may be present on the aryl and/or the alkyl portion of the group.

In one embodiment of the present invention, when n is 1 or greater than 1, each Z is the same.

In one embodiment of the present invention, the composition comprises two or more compounds of formula (I) having differing values of "n". In such compositions, one or more of the Z groups present in the compounds of formula (I) may, for example, be substituted with one or more groups of formula (V) such that groups of formula (V) having differing values of "m" are present in the composition or one or more of the compounds of formula (I).

In a preferred embodiment of the composition of the present invention, the compound(s) of formula (I) comprise one or more geminal bisferrocenylalkane, wherein the alkane bridge between the two ferrocenyl residues is formed by a saturated hydrocarbon, that is to say by an alkane. This alkane bridge can be branched, but it is preferably straight-chained. Compounds are particularly preferred which have a bridge with 2 to 4 carbon atoms and especially compounds with a propane bridge. 2,2-bisferrocenylpropane having the formula (VII) is, therefore, a highly preferred compound:

(VII)

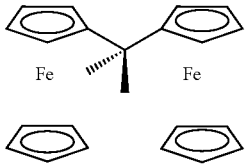

The compound of formula (VII) is considered to be an example of a compound having a straight-chained alkane bridging group.

The compound(s) of formula (I) may, for example, be present in the composition according to the present invention in an amount sufficient to provide, in the composition, at least 2 wt. %, e.g. at least 3 wt. %, of iron, based on the weight of the composition.

In one embodiment of the present invention, the compound(s) of formula (I) is/are present in the composition in an amount sufficient to provide, at −30° C., and preferably at −40° C., at least 1 wt. % of iron, based on the weight of the composition.

Preferably, the compositions according to the present invention are free, or substantially free, of compound(s) of formula (VIII):

A—Fe—B (VIII)

wherein A and B are as defined above.

In the composition according to the present invention the compound(s) of formula (I) is/are typically dissolved or dispersed, preferably dissolved, in the carrier or diluent. Preferably the carrier or diluent is an organic compound that is a solvent for the compound(s) of formula (I) such that, in the composition according to the present invention, the compound(s) of formula (I) is/are dissolved in the carrier or diluent.

The present invention also provides a method of regenerating a particle filter trap located in the exhaust system of a combustion system for fuel, for example located in the exhaust system of a high-compression, spontaneous ignition engine (e.g. a diesel engine), which comprises contacting carbon-based particulates, present in the particle filter trap, with combustion products of a composition according to the present invention. Typically the fuel is a hydrocarbon fuel. In this method, the composition according to the present invention may, for example, be located in a container associated with the combustion system for introduction into the fuel prior to combustion of the fuel in the combustion system.

The term "carbon-based particulates", as used herein, includes carbon-based particulates, e.g. soot particles, which carbon-based particulates are typically formed by incomplete combustion of the fuel within the combustion system but which may also be formed from combustion of lubricating oil or other organic-based materials used within the combustion system.

It is important that the carbon-based particulates, present in the particle filter trap, and the combustion products of the composition according to the present invention, especially solid, typically particulate, material present in the combustion products of the composition according to the present invention, be intimately mixed.

It is also important that the carbon-based particulates and the combustion products of the composition according to the present invention, present in the particle filter trap, be exposed to both heat and an oxidant gas (e.g. $O_2$ or $NO_2$), preferably both the heat and oxidant gas being supplied within the exhaust gases from the combustion system.

The present invention further provides the use of combustion products of the composition according to the present invention for decreasing the regeneration temperature (i.e. the temperature at which trapped carbonaceous material may be oxidised to gaseous products) of a particle filter trap located in the exhaust system of a combustion system for fuel, for example, in the exhaust system of a high-compression spontaneous ignition engine. Again, the fuel is typically a hydrocarbon fuel.

The present invention still further provides the use of a composition according to the invention as an additive to fuel, typically a hydrocarbon fuel, for decreasing the regeneration temperature of a particle filter trap located in the exhaust system of a combustion system for the fuel, for example, in the exhaust system of a high-compression spontaneous ignition engine.

Geminal bisferrocenylalkanes, wherein the alkane bridge between the two ferrocenyl residues is formed by a saturated hydrocarbon, that is to say by an alkane, have shown themselves to be particularly suitable for use in the present invention. This alkane bridge can be straight-chained, branched or cyclic, e.g. straight-chained or branched, but is preferably straight-chained. Compounds are particularly preferred which have a bridge with 2 to 4 carbon atoms. In particular, compounds with a propane bridge are excellent in their suitability for use in the present invention. 2,2-bisferrocenylpropane is, therefore, a highly preferred compound. Alkane-bridged ferrocene derivatives and the manufacture thereof are disclosed in the prior art, e.g. in U.S. Pat. No. 3,673,232.

Compounds of formula (I), where n in formula (III) is zero and A and B are unsubstituted cyclopentadienyl rings, may, for example, be prepared by the condensation of two equivalents of ferrocene with one equivalent of a carbonyl compound such as a ketone or aldehyde or an equivalent such as a ketal or acetal, respectively. In U.S. Pat. No. 3,673,232 this is accomplished by addition of the carbonyl compound or equivalent to a two phase system composed of a solution of strong acid, e.g. sulphuric acid, in alcohol, e.g. methanol, and a solution of ferrocene in an organic solvent, such as toluene, or a suspension of ferrocene in ferrocene-saturated toluene. Compounds of formula (I), where n in formula (III) is zero and one or more of A and/or B is a substituted cyclopentadienyl ring, e.g. alkylated ferrocenes, may also be prepared in this manner. Where the ferrocene or substituted ferrocene, used as starting material, is a liquid (e.g. molten) at the reaction temperature used in the preparation, then the two-phase system may comprise such liquid (e.g. molten) ferrocene compound in the absence of the organic solvent. Compositions containing mixtures of differently substituted ferrocenes, or of substituted ferrocenes with ferrocene itself, can be prepared through the use of appropriate mixtures of starting materials.

Changes to the manner and/or relative molar quantity of carbonyl compound or equivalent can be used to prepare compounds of formula (I) where n in formula (III) is non-zero. For example, reaction of 0.67 equivalents of acetone per molar equivalent of ferrocene will produce a product containing a mixture of unreacted ferrocene, a compound of formula (I) in which n is 0, a compound of formula (I) in which n is 1, and possibly higher oligomers. Addition of the acetone in two stages, first 0.6 equivalents then a further 0.3 equivalents when the reaction is substantially complete, would give a mixture containing a somewhat higher proportion of a compound of formula (I), in which n is 2, than the procedure described above involving the reaction of 0.67 equivalents of acetone. The relative proportions of oligomeric species present can also be adjusted by changing the addition profile of both the ferrocene and of the carbonyl compound or equivalent. Thus a high proportion of compound of formula (I) in which n is 1 should result from treatment of the reaction product of two molar equivalents of ferrocene with one of acetone, followed by addition of a further equivalent of each of ferrocene and acetone. Compositions containing mixtures of differently substituted or of substituted ferrocenes with ferrocene itself can be prepared through the use of appropriate mixtures of starting materials.

According to U.S. Pat. No. 3,673,232 varying the addition rate of the carbonyl compound or equivalent may result in the formation of compounds of formula (I), where n in formula (III) is other than zero.

Molecules or compositions containing different, substituted linking groups, Z, can be prepared by appropriate modifications to the schemes outlined above.

Compounds of formula (I) containing, on the hydrocarbyl group Z, substituent(s) of formula (V), where m is zero may be prepared in a number of ways. Amongst the simplest is the use, as the carbonyl compound or equivalent in the process outlined above, of a di-carbonyl species or equivalent, such as a dialdehyde or a diketone. Appropriate care needs to be taken with regard to the number of molar equivalents of each material present. Alternatively, a compound of formula (I) where n is 0 and containing, on the hydrocarbyl group Z, substituent(s) of formula (V), where m is zero, may be prepared as outlined above using a chlorinated aldehyde or ketone, and subsequently reacted with a lithiated ferrocene.

Compounds of formula (I), or mixtures containing compounds of formula (I), wherein Z is substituted with substituent(s) of formula (V) in which m is non-zero can also be prepared in several ways. For example, the reaction product of a diketone with four equivalents of a ferrocene may be further reacted with a single further equivalent each of ferrocene and a carbonyl-containing species, such as acetone. Alternatively, a diketone may be reacted with a mixture of ferrocene and a compound of formula (I) in which n is 0. A further possibility is the preparation of a compound of formula (I) where n is 0 by using a chlorinated aldehyde or ketone which may then be further reacted with a compound of formula (I) where n is 0 prepared from a non-functionalised aldehyde or ketone or equivalent.

Non-geminal alkane-bridged ferrocenes are also available by a number of routes and using ferrocene, substituted ferrocenes, or mixtures thereof. For example, a dihalogen compound, such as 1,4-dichlorobutane, may be reacted with a solution of lithiated ferrocene. Alternatively, a solution of sodium cyclopentadienyl, as used in many preparations of ferrocene, may first be reacted with the dihalogen compound and the resulting bridged cyclopentadiene mixed with fresh cyclopentadiene and used as in the conventional preparations of ferrocene.

Alkane-bridged ferrocenes wherein the alkane bridge contains heteroatoms may be prepared by routes well-known to those skilled in the art. For example, lithiated ferrocene may be reacted with 2-chloroethylether. Alternatively, acetyl ferrocene may be condensed, e.g. with ethylene diamine, and the resulting di-imine product optionally reduced to the diamine, e.g. with $NaBH_4$. As a further alternative, compounds containing both at least one carbonyl group or equivalent and one or more heteroatoms, for example, methoxyacetaldehyde(dimethylacetal) may be employed as starting materials.

It may be desirable for the compound of formula (I), when used in accordance with the present invention, to be free, or substantially free, of unreacted iron-containing material used as a starting material in the preparation of such compound of formula (I). For example, it is preferred, when the compound of formula (I) decreases the solubility or dispersibility of the iron-containing starting material in the carrier or diluent present in the composition of the invention, for the compound of formula (I) to be free, or substantially free, of the iron-containing starting material. A compound of formula (I) free, or substantially free, of iron-containing starting material may, for example, be obtained by selecting the reaction conditions for the preparation of such compound of formula (I) to give a high level of conversion, and/or by removal of iron-containing starting material using well known techniques such as distillation, sublimation or recrystallization. A person skilled in the art will readily be able to determine the reaction conditions appropriate to give a high level of conversion to the desired compound of formula (I).

When compositions according to the present invention (e.g. geminal bisferrocenylalkanes in an organic solvent) are supplied to the fuel and the fuel is supplied to the combustion system, the compound(s) of formula (I), e.g. the geminal bisferrocenylalkanes, react in the combustion system with the combustion mixture supplied to the combustion system and which comprises the fuel and air, to produce combustion products containing iron-containing species, e.g. iron oxides. Combustion of the fuel, and possibly lubricating oil or other organic carbon-based materials, within the combustion system produces combustion products which typically contain carbon-based particulates. The combustion products arising from the combustion of the composition according to the present invention and which comprises solid iron-containing species such as iron oxide(s), and the carbon-based particulates, are intimately mixed in the exhaust gases from the combustion system and the particulate material is filtered out by the particle filter trap. Whilst not wishing to be bound by theory, it is believed that particulate material present in the combustion products of the composition according to the present invention, which particulate material comprises iron-containing species such as iron oxide(s), is responsible for, or at least contributes to, a lowering of the ignition temperature of the carbon-based particulates and, hence, the regeneration temperature of the particle filter trap. Therefore, at the operating temperature of the filter, episodes of spontaneous ignition occur and the carbon-based particulates, e.g. soot particles, are burned off to produce gaseous products. Alternatively, means may be used to raise the temperature of the particle filter or of the exhaust gases, thereby obtaining a so-called "forced regeneration" with the presence of the products, obtained from the combustion of the composition according to the present invention, serving to reduce the input of energy required to achieve the "forced regeneration". Consequently, in combustion systems comprising particle filters which are present in the exhaust side of the system and designed for permanent operation, and which thus need to be regenerated, the use of the compositions according to the present invention avoids the need for costly additional measures or installations, e.g. burners, electric heaters or additional catalytic systems, for burning off the carbon-based particles which have been filtered out. This means that particle filter traps, e.g. diesel particle filter traps, can be manufactured cost-effectively for permanent use without large additional expenditure. Alternatively, if desired, one or more of the above-mentioned additional measures may be employed in which case their effectiveness and/or cost effectiveness, particularly where extra fuel is burned to raise the exhaust gas temperature, may be enhanced by the use of the composition according to the present invention, or lower treat rates (i.e. level of addition to the fuel) of the compound(s) of formula (I) may be used.

It is believed that the intimate mixing of the carbon-based particulates and the particulate material present in the combustion products of the composition according to the present invention results in:

(a). at least a portion of the surface of the carbon-based particulates being coated with solid combustion products of the composition according to the present invention;

(b). at least a portion of the surface of solid combustion products of the composition according to the present invention being coated with the carbon-based particulates; and/or (c). solid combustion products of the composition according to the present invention being intimately mixed with particles of the carbon-based particulates.

Preferably, the compositions according to the present invention are metered into the fuel, e.g. from a supply container. This metered addition to the fuel may, for example, take place shortly before the fuel is supplied to the combustion system, e.g. an internal combustion engine present in a vehicle. Alternatively, the metered addition to the fuel may, for example, take place as or shortly after the fuel is charged to the fuel tank supplying the combustion system, e.g. the fuel tank of a vehicle when the combustion system is an internal combustion engine located in the vehicle.

Fuels that may be used in high compression spontaneous ignition engines are typically conventional fuels for such engines, particularly diesel fuel, including biodiesel.

In addition to high compression spontaneous ignition engines, referred to hereinabove, the compositions according to the present invention may be used in other types of combustion systems wherein particulate emissions are regarded as a problem, for example, spark ignition engines using gasoline, and especially gasoline direct injection engines.

When the combustion system is an internal combustion engine on a vehicle and a composition according to the present invention is supplied to the fuel from a supply container located on the vehicle, it is particularly advantageous for the supply container to be as small as possible since this is space and weight conserving. In order that the supply container for the composition according to the present invention can be kept as small as possible, the composition according to the present invention should preferably be of a relatively high concentration with respect to the compound(s) of formula (I). Secondly, when the composition according to the present invention is metered into the fuel, the concentration of the compound(s) of formula (I) in the composition should not be so great that excessive requirements need to be imposed upon the accuracy of the metering operation in order to achieve permanent and constant metering into the fuel.

A concentration of iron up to a maximum of 30% by weight is advantageously present in the composition according to the present invention. Preferably, the composition has an iron content of up to 10% by weight, more preferably up to 7% by weight. An even more preferred composition has an iron content of from 2.0-5% by weight, and a yet more preferred composition has an iron content of from 2.5-5% by weight.

Not only should the compound(s) of formula (I) have a high degree of solubility or dispersibility, preferably solubility, in the diluent or carrier present in the composition, but also the composition comprising the compound(s) of formula (I) and the carrier or diluent should have temperature stability across a wide temperature range. In particular, no stability problems should result within the range of from −25° C. to +90° C., and preferably within the range of from −40° C. to +90° C. Whilst relatively high temperatures generally do not cause any problems if the vapour pressure of the carrier or diluent selected is not excessive at high temperatures, the stability at low temperatures is a problem with many iron-organic compounds. In this respect, it has surprisingly been shown that bisferrocenyl alkanes, including geminal bisferrocenylalkanes, e.g. 2,2-bisferrocenylpropane, dissolve in organic solvents to give a solution having an iron content of up to 10 wt. %, are stable down to −25° C., and partially stable down to −40° C. and beyond. Further, it has been found that 2,2-bisferrocenyl propane solutions containing 2.5 wt % iron are stable at −40° C.

The diluent or carrier is preferably an organic solvent in which the compound(s) of formula (I), e.g. the geminal bisferrocenylalkanes, is/are dissolved. Suitable organic solvents include highly aromatic solvents in which the compound(s) of formula (I), e.g. the geminal bisferrocenylalkanes, is/are highly soluble. However, if desired a non-aromatic or low aromatic solvent may be used. In the case of non-aromatic or low aromatic solvents, the absolute solubility of the compound(s) of formula (I) therein will be lower than in highly aromatic solvents but the solubility relative to ferrocene will typically still be higher. A highly aromatic solvent with aromatic substances having 9 to 16 carbon atoms and a boiling range of >170° C. to 295° C., and a total aromatic substance content of >98% by weight is particularly suitable. A solvent such as this is PLUTOsol™ APF.

An advantage of the geminal bisferrocenylalkane compounds is that the viscosity of compositions according to the present invention containing such compounds is not too greatly increased within the low temperature range. This could otherwise have adverse effects upon the pumpability of the compositions and could, for example, result in difficulties in conjunction with a metering pump. In this connection, the viscosity of compositions according to the present invention, containing one or more geminal bisferrocenylalkane compound and having an iron content of 2.5% by weight, is less than, or approximately equal to, 25 mPas at a temperature of −40° C.

Compositions according to the present invention are typically supplied to the fuel by means of a metering unit, e.g. by means of a metering pump, in quantities such that the iron content thereof is 0.1-100 ppm following the addition. On the one hand, the quantity of the compound(s) of formula (I) to be added to the fuel should be great enough to ensure optimum possible burning off of the carbon-based particulates from the particle filter but, on the other hand, should not be excessively high from the point of view of cost and the eventual partial or complete blockage of the particulate filter trap that may occur due to ash derived from the addition to the fuel of an excessive amount of the compound(s) of formula (I). An iron content of the fuel within the range of 1-25 ppm has proven advantageous, the optimum range being 5-15 ppm, in particular in the preferred combustion system (i.e. high compression spontaneous ignition engines).

If the compound(s) of formula (I) are liquid at ambient temperature, and preferably liquid at from −25° C. to +90° C., and more preferably liquid at temperatures of from −40° C. to +90° C., then it may be possible to use such compound(s) in accordance with the present invention in the absence of carrier or diluent.

According to further aspects of the present invention there are provided:

The use of geminal bisferrocenylalkanes, e.g. 2,2-bisferrocenylalkanes, as an additive for liquid fuels for operation of high compression spontaneous ignition engines (e.g. diesel engines) with downstream particle filter systems.

Preferably, in the geminal bisferrocenylalkanes, e.g. 2,2-bisferrocenyl-alkanes, the alkane bridge between the two ferrocenyl fragments is formed by a saturated hydrocarbon (i.e. an alkane) which may be branched or straight chained.

Preferably, in the geminal bisferrocenylalkanes, e.g. 2,2-bisferrocenyl-alkanes, the alkane bridge between the two ferrocenyl fragments is an alkane with 1 to 8, particularly 2 to 4, especially 3, carbon atoms, and more preferably, is a straight chain alkyl with 1 to 8, particularly 2 to 4, especially 3, carbon atoms.

Preferably, the geminal bisferrocenylalkane, e.g. 2,2-bisferrocenyl-alkane, is 2,2-bisferrocenylpropane.

Preferably, the geminal bisferrocenylalkane, e.g. 2,2-bisferrocenylalkane, is dissolved in an organic solvent, preferably in a highly aromatic solvent.

Preferably, the concentration of the geminal bisferrocenylalkane, e.g. 2,2-bisferrocenylalkane, in the solvent is at a level such that the solution exhibits an iron content of 0.1-10 weight percent, preferably 1 to 7 weight percent, more preferably 2.0 to 5 weight percent and especially 2.5-5 weight percent.

Preferably, the solution exhibits cold temperature stability down to at least −25° C., in particular, down to at least −40° C.

Preferably, the solution exhibits a viscosity of <25 mPas, e.g. <24 mPas, with an iron content of 2.5 weight percent at a temperature of −40° C.

Preferably, the highly aromatic solvent is a highly aromatic solvent with aromatic substance content of >98% by weight.

Preferably, the highly aromatic solvent is a highly aromatic solvent with aromatic substances within the range of 9-16 carbon atoms and a boiling range of >170-295° C. and a total aromatic substance content of >98% by weight. An example of such a solvent is PLUTOsol APF.

Preferably, the solution of the geminal bisferrocenylalkane, e.g. 2,2-bisferrocenylalkane, is dosed into the fuel before it is fed to the engine.

Preferably, the solution of the geminal bisferrocenylalkane, e.g. 2,2-bisferrocenylalkane, is dosed to the fuel such that the iron content of the fuel is 0.1 to 100 ppm, more preferably 1 to 25 ppm, and particularly 5 to 15 ppm.

Preferably, one or more of the four cyclopentadienyl rings of the geminal bisferrocenylalkane, e.g. 2,2-bisferrocenylalkane, independently of one another is substituted, e.g. carries at least one alkyl group with 1 to 4 carbon atoms, more preferably an ethyl group, as a substituent. For example, each of the four cyclopentadienyl rings may be substituted.

Preferably, only the two bridged rings each carry a substituent, and preferably such substituents are the same (e.g. an ethyl group).

Preferably, the particle filter systems are designed in such a way that filtered-out soot particles are burnt off as a result of the addition of the geminal bisferrocenylalkane, e.g. 2,2-bisferrocenylalkane, to the fuel.

Preferably, the liquid fuel is a conventional fuel for high-compression, spontaneous ignition engines, particularly diesel fuel, including biodiesel.

The compositions according to the present invention may, for example, comprise one or more additives in addition to the compound of formula (I), for example, to improve various aspects of the fuel to which the composition is typically added or to improve various aspects of the combustion system performance. Suitable additional additives include detergents, carrier oils, anti-oxidants, corrosion inhibitors, colour stabilisers, metal deactivators, cetane number improvers, other combustion improvers, antifoams, pour point depressants, cold filter plugging depressants, wax anti-settling additives, dispersants, reodorants, dyes, smoke suppressants, lubricity agents, and other particulate filter regeneration additives.

In addition to aiding in the regeneration of particle filter traps located in the exhaust system of a combustion system for fuel, it is believed that the compositions according to the present invention may, when present in the combustion system during combustion of the fuel, give rise to improved combustion of the fuel and thus have a positive influence upon the exhaust gas values.

The present invention still further provides a method of purifying a compound according to the invention, which comprises extracting the compound with carbon dioxide, typically supercritical carbon dioxide.

The following Examples are presented to illustrate certain embodiments of the present invention.

EXAMPLES

Comparative Example 1

At −15° C., the solubility of ferrocene in the highly aromatic solvent PLUTOsol™ APF was found to be 1.5% by weight in relation to the iron content of the solution and at −40° C. was found to be 0.72% by weight.

Example 1

For 2,2-bisferrocenylpropane, under the conditions disclosed in Comparative Example 1, solutions with an iron content of 7.5% by weight were found to be stable without any problems.

Example 2

A solution of 2,2-bisferrocenylpropane in PLUTOsol™ APF with an iron content of 2.5% by weight was found to have a viscosity of 8.6 mPas at a temperature of −15° C. and of 21 mPas at a temperature of-40° C. Further viscosity/temperature observations are given in Table 1 below.

TABLE 1

| Temperature [° C.] | Viscosity [mPas] |
|---|---|
| −40 | 21.0 |
| −30 | 14.8 |
| −20 | 10.5 |
| −15 | 8.6 |
| −10 | 6.8 |
| 0 | 4.8 |
| 20 | 2.7 |
| 25 | 2.5 |
| 40 | 2.2 |
| 50 | 2.2 |
| 60 | 2.0 |
| 90 | 2.0 |

Example 3

Table 2 shows, for a solution of 2,2-bisferrocenylpropane in PLUTOsol™ APF with an iron content of 2.5% by weight, the observed vapour pressure behaviour of the solution in dependency on temperature.

TABLE 2

| Temperature [° C.] | Vapour Pressure [mbar] |
|---|---|
| 20 | 1 |
| 40 | 2 |
| 50 | 3 |
| 60 | 5 |
| 70 | 8 |
| 80 | 13 |
| 90 | 20 |

Example 4

Fuel Stability, ASTM D2274[(1)]

TABLE 3

| | | DF, clear[(2)] | DF[(3)], 2,2-bisferrocenylpropane as additive (20 ppm iron) |
|---|---|---|---|
| Colour No. | Start of Test | <0.5 | <0.5 |
| | End of Test | <1.0 | <1.0 |
| | Filter Assessment | | |
| Total insolubles/ filterable and adherent [mg/100 ml] | | 0 | 0 |

[(1)]Fuel ageing at 95° C. over 16 hrs with air, subsequent filtration and assessment of the filtration pad (Whatman No. 1; 11 μm). Two-fold assessments were carried out each time.
[(2)]DF, clear = diesel fuel with no 2,2-bisferrocenylpropane as additive.
[(3)]DF = diesel fuel.

This Example demonstrates that the presence of 2,2-bisferrocenylpropane in the fuel does not adversely affect the stability of the fuel.

Example 5

Fuel Stability Tests According to Two In-House Test Methods

Test Method 1:

A fresh sample of base fuel, as described in Table 7 below, from storage under nitrogen blanket at −7° C. to 5° C., was filtered through a No. 4 Gooch crucible filter containing two Reeves Angel 2.4 cm glass fibre filter papers and the colour determined according to ASTM D1500. 100 $cm^3$ samples of the fuel were then charged to scrupulously cleaned borosilicate glass screw-cap (cap contains a 6 mm vent hole) bottles (Corning1372). Additive stock solutions were then added to fuel samples as appropriate and the fuel colour re-determined. The samples were then promptly placed in an explosion-proof oven set at 80° C. ±2° C. Samples were aged for 7 days at this temperature before removal and cooling in the absence of strong light to ambient (21° C. to 26° C.) over a period of between 3 and 24 hours.

TABLE 4

| Reflectometer reading (% Reflection) | Visual Fuel Stability Rating (Photographic standard no.) | Quality of stability |
|---|---|---|
| 80-100 | 1-3 | Excellent |
| 65-79 | 4-6 | Good |
| 55-64 | 7-9 | Marginal |
| 30-54 | 10-15 | Poor |
| 0-29 | 16-20 | Very poor |

Test Method 2:

The procedure for the ageing of the fuel was identical to that of Test Method 1 but there were slight differences in the analysis. In this test method the adherent material was released from the walls of the sample bottle by washing with trisolvent (1:1:1 methanol:acetone:toluene), re-precipitated with iso-octane, collected on a separate filter paper and rated separately. Additionally, a weight of filterable and adherent deposits was obtained through weighing of the dried filter papers before and after filtration. Results from this test method are given in Table 5 below.

TABLE 5

| | | Results (From Test Method 2, unless otherwise stated) | | | |
|---|---|---|---|---|---|
| | | Base Diesel | Ferrocene Additive (20 ppm iron) Test Method 2 | 2,2-bisferrocenyl propane Additive (20 ppm iron) Test Method 2 | Octanoate[(1)] Additive (20 ppm iron) Test Method 1 |
| Colour | Start | <0.5 | <0.5 | <0.5 | <1.0 |
| | Finish | <0.5 | <0.5 | <0.5 | 1.5 |
| Filterable | Visual | 1 | 1 | 1 | 15* |
| Residues rating | Reflectance (%) | 98 | 98 | 97 | |
| | Weight (mg) | 14 | 15 | 12 | |
| Adherent | Visual | 1 | 1 | 1 | |
| Residues rating | Reflectance (%) | 98 | 98 | 98 | |
| | Weight (mg) | 0 | 0 | 0 | |

[(1)]Octanoate = commercial iron complex, Iron tris(2-ethylhexanoate).
*= value for combined filtrable and adherent residues.

The entire fuel samples were then each filtered under vacuum through separate 4.25 cm No. 1 Whatman filter papers (referred to below as "original filter paper") held in a Millipore filter holder assembly Cat. No. XX20 047 20. The filter papers were then stored briefly in separate vacuum flasks whilst the colour of the filtered fuel was determined by ASTM D1500. The borosilicate sample bottles were then rinsed with several aliquots of iso-octane, and the washings filtered through the respective original filter paper. Finally, the filter papers themselves were washed with iso-octane and allowed to air dry.

A reflectance meter (Photovolt Reflectometer) is ideally then used to rate the filter paper to eliminate the possibility of observer bias and improve inter-operator comparability. However, where such a meter is not available, the filter papers may (as on this occasion) be visually rated for contamination by comparison to a photographic set of standards; these standards rate between 1 (white) and 20 (very dark grey-brown). Results from this test method are given in Table 5 below.

The following Table 4 correlates photographic standards against meter readings

Clearly fuel containing the commercial iron complex shows markedly lower stability under this test than do those containing ferrocene and 2,2-bisferrocenylpropane. The stability of the material of the current invention is shown to be as good as that provided by the parent compound (ferrocene) and virtually indistinguishable from that of untreated fuel.

Example 6

Test Method

A suitable engine test procedure to allow performance screening for candidate fuel additives and different DPF (diesel particulate filter) technologies is as set out below. The development and form of this test are more fully set out by B Terry and P Richards in "A Method for Assessing the Low Temperature Regeneration Performance of Diesel Particulate Filters and Fuel-borne Catalysts" SAE 2000-01-1922.

The test method used in this Example was as set out in the above-mentioned SAE 2000-01-1922 and was as follows:

A set of five test points from within the much larger matrix for engine operation was used as set out below in Table 6, the five test points are marked with a *.

TABLE 6

| | | Test matrix | | | |
|---|---|---|---|---|---|
| | | Engine Speed (rev/min) | | | |
| | | 1260 | 1550 | 2710 | 3000 |
| Engine | 5 | * | | | |
| Torque | 10 | | * | | |
| (Nm) | 20 | | * | | |
| | 30 | | | * | * |

For each of these test conditions the engine was operated for 14 hours. To protect the DPF from thermal damage, resulting from excessive soot burnout, an arbitrary exhaust back pressure limit was set for each of the operating conditions. If this limit was reached the engine duty was increased to raise the exhaust gas temperature to the point where the trapped soot would oxidise (i.e. high duty operating conditions). If however, the soot spontaneously oxidised during normal steady state operation then no further action was required. The arbitrary exhaust back pressure limit was set to 300 mbar for each of the operating conditions. The test protocol thus consisted of the following;

start the engine, allowing a minute for the engine fluids to begin to warm up.

run for a total of 70 hours at the steady state operating conditions.

run the engine at the high duty operating condition to produce a forced regeneration in order to secure soot burnout prior to the next test.

Tests were run with the five operating conditions in the sequence 3000/30, 1550/10, 1260/5, 2710/30 and 1550/20.

An averaging window is set up such that the exhaust pressure at the start and finish of the window is equal, thus eliminating any warm up effects. The mean exhaust back pressure is then used as the criterion for assessing the system performance. The lower the mean exhaust back pressure, the better the system performance.

Test Engine, Equipment and Fuel

The work was undertaken using a Peugeot XUD-9A engine mounted on a pallet arrangement and equipped with appropriate heat exchangers, electrical connections and connectors for instrumentation signals. This pallet arrangement was connected to the engine test bench. The engine dynamometer was a Froude AG150 eddy current machine controlled by the CP Engineering Cadet system. Engine operating temperatures were controlled automatically by suitable 3-term controllers integrated into the secondary coolant system supplies. The test bench was controlled and data logged using a CP Engineering Cadet system.

The test engine was of the indirect injection (IDI) type, employing a Ricardo Comet type pre-chamber design. The engine design was a four cylinder, in-line with a single overhead camshaft operating two valves per cylinder. The total swept volume of the engine was 1905 $cm^3$. The engine was naturally aspirated with a 23.5:1 compression ratio and was fitted with a Roto-Diesel fuel pump and Bosch pintle type fuel injectors.

The engine exhaust system was modified to allow ready interchange of a center section which could incorporate a selection of DPFs.

The non-additised base fuel used throughout this study was an EN 590 specification fuel. An analysis of the fuel is given in Table 7.

TABLE 7

| Description | ULSD (Ultra Low Sulfur Diesel) |
|---|---|
| Sample number | 992662 |
| Density, Kg/litre @ 15° C. | 0.8299 |
| Density, Kg/litre @ 20° C. | 0.8262 |
| Viscosity, cSt @ 40° C. | 2.6811 |
| Cloud point, ° C. | −7 |
| Pour point, ° C. | −24 |
| Sulphur content, mg/kg | 35 |
| Distillation: | |
| IBP(1) @ ° C. | 168.0 |
| 10% vol. @ ° C. | 209.0 |
| 50% vol. @ ° C. | 269.5 |
| 90% vol. @ ° C. | 327.5 |
| FBP(2) @ ° C. | 352.5 |
| FIA(4) analysis: | |
| % vol. Saturates | 78.6 |
| % vol. Olefins | 0.6 |
| % vol. Aromatics | 20.8 |
| Cetane number | 52.8 |
| Calculated cetane index | 54.9 |
| Flash point, ° C. | 64.0 |
| CNI(3) content, % v/v | 0.000 |
| Gross heat of combustion, Cal/g | 11194 |
| Net heat of combustion, Cal/g | 10433 |

(1)= Initial Boiling Point
(2)= Final Boiling Point
(3)= Cetane Number Improver
(4)= Fluorescent Indicator Adsorption (IP 156/92 and ASTM D 1319-88)

Comparison of Additives

To determine whether running the engine at these conditions would discriminate between different fuel-borne catalysts, tests were run using ferrocene and 2,2-diferrocenylpropane as fuel additive. Both were used at the appropriate treat rate to give a total of 20 ppm of metal in the fuel. The additives were both tested in the same SiC DPF (silicon carbide diesel particulate filter).

Results

TABLE 8

Engine condition (speed in rev/min, load in Nm) and pre-DPF pressures (mBar) for five key test conditions, ferrocene additive:

| Condition | Position in test | Max.* | Min** | Mean*** | σ Standard Deviation (mBar) | Mean + 2σ (mBar) |
|---|---|---|---|---|---|---|
| 1260/5 | 3 | 115 | 40 | 75 | 18 | 110 |
| 1260/5 | 8 | 111 | 40 | 74 | 16 | 107 |
| 1550/10 | 2 | 134 | 26 | 107 | 38 | 184 |
| 1550/10 | 7 | 234 | 24 | 112 | 53 | 218 |
| 1550/20 | 5 | 234 | 20 | 106 | 51 | 207 |
| 1550/20 | 10 | 191 | 36 | 108 | 38 | 185 |
| 2710/30 | 4 | 206 | 107 | 162 | 18 | 199 |
| 2710/30 | 9 | 234 | 111 | 170 | 24 | 218 |

TABLE 8-continued

Engine condition (speed in rev/min, load in Nm) and pre-DPF pressures (mBar) for five key test conditions, ferrocene additive:

| Condition | Position in test | Max.* | Min** | Mean*** | σ Standard Deviation (mBar) | Mean + 2σ (mBar) |
|---|---|---|---|---|---|---|
| 3000/30 | 1 | 270 | 99 | 187 | 33 | 253 |
| 3000/30 | 6 | 266 | 95 | 182 | 36 | 253 |

*Max = the maximum pre-DPF pressure in mBar.
**Min = the minimum pre-DPF pressure in mBar.
***Mean = the mean pre-DPF pressure in mBar.

TABLE 9

Engine condition (speed in rev/min, load in Nm) and pre-DPF pressures (mBar) for five key test conditions, 2,2-diferrocenylpropane additive:

| Condition | Position in test | Max. | Min | Mean | σ | Mean + 2σ |
|---|---|---|---|---|---|---|
| 1260/5 | 3 | 127 | 48 | 81 | 15 | 112 |
| 1260/5 | 8 | 151 | 48 | 88 | 24 | 136 |
| 1550/10 | 2 | 202 | 12 | 101 | 39 | 176 |
| 1550/10 | 7 | 214 | 28 | 116 | 42 | 201 |
| 1550/20 | 5 | 175 | 24 | 85 | 36 | 157 |
| 1550/20 | 10 | 131 | 44 | 86 | 17 | 121 |
| 2710/30 | 4 | 183 | 131 | 159 | 8 | 174 |
| 2710/30 | 9 | 179 | 131 | 153 | 10 | 172 |
| 3000/30 | 1 | 187 | 123 | 155 | 11 | 176 |
| 3000/30 | 6 | 214 | 135 | 180 | 14 | 208 |

From Tables 8 and 9, comparing the two additives, within each set clearly the more reproducible pair of results is the mean back pressure.

TABLE 10

Comparing the mean back pressures, in mBar, (and standard deviations) for the two additives.

| Condition | Ferrocene additive | | 2,2-Diferrocenylpropane additive | |
|---|---|---|---|---|
| 1260/5 | 75 (18) | 74 (16) | 81 (15) | 88 (24) |
| 1550/10 | 107 (38) | 112 (53) | 101 (39) | 116 (42) |
| 1550/20 | 106 (51) | 108 (38) | 85 (36) | 86 (17) |
| 2710/30 | 162 (18) | 170 (24) | 159 (8) | 153 (10) |
| 3000/30 | 187 (33) | 182 (36) | 155 (11) | 180 (14) |

From the above Table 10, comparing ferrocene and 2,2-bisferrocenylpropane, it can be seen that 2,2-bisferrocenylpropane is at least as effective as, and possibly superior to, ferrocene in the regeneration of particulate filter traps in diesel engines and by implication in other combustion systems.

Example 7

The existence of any effects on solubility and solution viscosity due to changes in the substitution on the aromatic ring and/or on the bridging group was examined by preparation of a series of bridged ferrocenes i.e. compounds according to formula 1 of the present invention. Two sets of standard conditions were employed for the preparation and isolation of these products, for use with un-substituted and alkylated ferrocene, respectively. Variation of these conditions to arrive at optimum syntheses of particular derivatives, in particular to maximise the yield on ferrocene, minimise formation of side-products such as alkenylated ferrocenes and minimise the effort required to separate the desired soluble products, is deemed to be within the scope of those skilled in the art.

Preparation of Bridged Ferrocenes:

Sulphuric acid (98 wt % $H_2SO_4$, 196 g, 2.0 mol) was added carefully to methanol (214.4 g, 6.7 mol) in a conical flask. The solution temperature was maintained at below 40° C. by cooling (ice-water bath) and changing the addition rate. The solution was transferred to a jacketed, well-baffled one litre reactor equipped with an overhead turbine agitator, reflux condenser, dropping funnel, thermometer and bottom outlet. The reactor was then further charged with powdered ferrocene (130.2 g, 0.7 mol) washed in with toluene (130 g).

The reactor contents were then warmed to 80±2° C. by the circulation of hot oil through the jacket, and were rapidly stirred to create an emulsion of the methanolic phase and toluene slurry. The carbonyl compound (0.35 mol, 1 equivalent) was then charged to the dropping funnel and added dropwise to the reactor over about 15 minutes at a substantially uniform rate. The reactor contents were then held, with strong agitation, at 80°±2° C. for 6 hours before being allowed to cool to ambient temperature overnight.

Where ferrocene crystallised out on cooling this was removed by filtration. Further toluene (130 g) was then added to the liquid phases, and after a further 15 minutes stirring, water (10 $cm^3$) was added, where required to aid phase separation and agitation stopped. The methanol/sulphuric acid phase was then separated and the organic phase washed with aqueous base (2×200 $cm^3$ 10% $NaHCO_3$ or NaOH) then water (2×200 $cm^3$), dried over anhydrous sodium sulphate and separated by filtration to remove the drying agent. Crude product mixture, contaminated by varying amounts of unreacted ferrocene was recovered by removal of the toluene at the rotary evaporator.

Isolation of Bridged Ferrocenes:

Solid materials were ground in a pestle and mortar in the presence of heptane and filtered to recover solids. The process was repeated until thin layer chromatography (Merck Aluminium oxide 150 $F_{254}$ (Type T) stationary phase, 3 to 4 parts EtOH to 1 $H_2O$ as mobile phase) indicated the solids to be substantially free of ferrocene. The material was then dissolved in a minimal quantity of hot heptane, hot-filtered, then recovered by recrystallisation on cooling.

Crude products were on occasion oils free or substantially free of solids. The products were found to phase-separate from heptane on refrigeration and so were separated from ferrocene, which tended to remain in solution. Again, progress was monitored by tlc.

On occasion crude products comprised mixtures of oil and solid. Here, a judgement was made as to which if the above techniques was more likely to be appropriate (i.e. a sticky solid would be ground with heptane in a pestle and mortar, an oil containing suspended solids would be dissolved in the minimum of hot heptane, then refrigerated). Where time and quantity of material available permitted, trial separations were performed. Again, purification method selection and/or progress was monitored by tlc.

Final and near-complete removal of ferrocene from solid, oil or mixed phases was achieved by sublimation at <0.6 mBar, 80° C.

Preparation of Bridged, Alkylated Ferrocenes:

Alkylated ferrocenes provided reaction products with carbonyl compounds that were viscous oils at ambient temperature, becoming highly mobile on warming. Accordingly, emulsions comprising methanolic sulphuric acid and solutions of alkylated ferrocenes in toluene were treated with 0.5 equivalents of carbonyl compound at 80° C., as above. The organic phases were separated, washed with base and dried. Toluene solvent and unreacted alkylated ferrocenes were removed by distillation to leave the products as oils. No further isolation was required.

Determination of Product Properties:

Iron contents of the samples were estimated on the basis of C/H/N analysis (Leco CHNS 932). This assumes that all isolated products were free, or substantially so, of unreacted carbonyl compounds, or oxygen-containing reaction products thereof. Ferrocene contents of the samples were determined by GC/MS on a Finnigan MAT GCQ (GC/MS), using a Supelco MDN-5S fused silica capillary column (30 m×0.25 mm i.d. 0.25μ film thickness) initial temperature 40° C., held for 2.1 minutes before ramping to 200° C. at 10° C.min$^{-1}$ before holding for 20 minutes, injector temperature 275° C., He flow 40 cm.s$^{-1}$ constant velocity, calibrated against pure ferrocene.

Where suitably crystalline materials could be obtained, further characterisation was performed using $^{1}$H and $^{13}$C nmr (Bruker AC200). Integration of cyclopentadienyl protons [shift range 4-4.5 ppm downfield of TMS (tetramethylsilane) in $C_6D_6$] against those of any carbonyl-derived bridging unit was used, where possible, to provide qualitative information on the degree of oligomer formation. All spectra were run in $C_6D_6$ solution with shifts reported relative to TMS. Where possible, carbon atoms were identified as methyl, methylene or methyne, via the DEPT (Distortionless Enhancement by Polarisation Transfer) experiment.

Solubility testing was undertaken using the estimate of Fe content from C/H/N analysis. Since the iron content of ferrocene is known to be 30 wt %, that present as condensation products was estimated by difference. This procedure assumes the products below to contain substantially only C, H and Fe. Masses of product(s) sufficient to provide the required concentration of iron as condensation products were weighed into screw-cap vials and made up to 10.00 g with toluene. The samples were capped, shaken or swirled until homogenous then sealed using Parafilm™. The vials were then kept in an ethylene glycol/water filled bath held at −30° C. and periodically inspected for the appearance of solids or separation of liquid phases. After at least one week solids were separated by rapid filtration and soluble products isolated by removal of solvent under vacuum. Following analysis of the solids, maximum and minimum solubilities were estimated from the mass balance.

Viscosities of 2.5 wt % iron solutions were determined using a Bohlin Instruments CVO rheometer using a 4° 40 mm cone and plate at shear rates of either 2 Pa or 0.5 Pa.

TABLE 11

Theoretical Analyses for Condensation Products of Ferrocenes with Carbonyl Compounds

| | | Calculated for n = 0 | | | Calculated for n = 1 | | |
|---|---|---|---|---|---|---|---|
| Compound No. | Carbonyl Compound | C (% m/m) | H (% m/m) | Fe (% m/m) | C (% m/m) | H (% m/m) | Fe (% m/m) |
| 1 | Acetone | 67.02 | 5.88 | 27.10 | 67.74 | 6.01 | 26.25 |
| 1a | Acetone (9% oligomer) | 66.59 | 5.85 | 27.56 | 67.74 | 6.01 | 26.25 |
| 2 | Methylal | 65.66 | 5.26 | 29.08 | 66.02 | 5.20 | 28.78 |
| 3 | Butyraldehyde | 67.63 | 6.16 | 26.21 | 68.49 | 6.37 | 25.14 |
| 4 | 2-Ethylhexanal | 69.72 | 7.12 | 23.16 | 70.96 | 7.52 | 21.52 |
| 5 | Isobutyraldehyde | 67.63 | 6.16 | 26.21 | 68.49 | 6.37 | 25.14 |
| 6 | Isovaleraldehyde | 68.20 | 6.42 | 25.37 | 69.18 | 6.69 | 24.13 |
| 7 | Pentanal | 68.20 | 6.42 | 25.37 | 69.18 | 6.69 | 24.13 |
| 8 | Benzaldehyde | 70.46 | 5.27 | 24.27 | 71.96 | 5.23 | 22.82 |
| 9 | Phenylacetaldehyde | 70.91 | 5.54 | 23.55 | 72.46 | 5.56 | 21.98 |
| 10 | p-Tolualdehyde | 70.91 | 5.54 | 23.55 | 72.46 | 5.56 | 21.98 |
| 11 | Cyclohexanone | 69.05 | 6.25 | 24.70 | 70.21 | 6.47 | 23.32 |
| 12 | 1,3-Cyclohexanedione | 67.35 | 5.42 | 27.23 | 67.71 | 5.42 | 26.88 |
| 13 | 2,4-Pentanedione | 66.86 | 5.50 | 27.64 | 67.16 | 5.51 | 27.33 |
| 14 | 2,3-Butanedione | 66.53 | 5.34 | 28.13 | 66.80 | 5.33 | 27.88 |
| 15 | Acetonyl acetone | 67.18 | 5.65 | 27.17 | 67.52 | 5.68 | 26.80 |
| 16 | Acetone[1] | 69.25 | 6.90 | 23.85 | 69.82 | 6.99 | 23.19 |
| 17 | Propionaldehyde[2] | 69.25 | 6.90 | 23.85 | 69.82 | 6.99 | 23.19 |
| 18 | Acetone[2] | 69.25 | 6.90 | 23.85 | 69.82 | 6.99 | 23.19 |
| 19 | Pentan-3-one[2] | 70.17 | 7.33 | 22.50 | 70.96 | 7.52 | 21.52 |
| 20 | Heptan-4-one[2] | 71.00 | 7.70 | 21.30 | 71.94 | 7.99 | 20.07 |

The terms calculated for n=0 and n=1 in the table above refer, respectively, to compounds of formula I wherein n in formula III is 0 or 1. Entry 1a refers to a lower purity fraction isolated from the condensation reaction of 0.6 equivalents of acetone with ferrocene. From the $^{1}H$ nmr spectra integration of the methyl group protons against cyclopentadienyl ones suggested that, assuming only species wherein n=0 and n=1 to be present, about 9 mol % n=1 had resulted.

Notes:

Compounds 1-15 were prepared using ferrocene.

[1] compounds were made using dimethylferrocene such that A and B in formulae II and III are both methylcyclopentadienyl groups.

[2] compounds were made using ethylferrocene such that one of A or B in formula II and in formula III is ethylcyclopentadienyl, the other being, in each case, cyclopentadienyl.

TABLE 12

Analytical Details for Isolated Compositions.

| Compound No. | Carbonyl Compound | Found C (% m/m) | Found H (% m/m) | Implied [Fe] (% m/m) | Ferrocene Content (% m/m) | Iron as product (% m/m) |
|---|---|---|---|---|---|---|
| 1 | Acetone | 66.11 | 5.67 | 28.22 | n.d. | 28.22 |
| 1a | Acetone (9% oligomer) | 66.35 | 5.62 | 28.03 | n.d. | 28.03 |
| 2 | Methylal | 65.60 | 5.16 | 29.24 | | 29.24 |
| 3 | Butyraldehyde | 67.17 | 6.10 | 26.69 | n.d. | 26.69 |
| 4 | 2-Ethylhexanal | 73.20 | 8.15 | 18.65 | <1.0 | 18.65 |
| 5 | Isobutyraldehyde | 71.19 | 6.97 | 21.84 | <1.0 | 21.84 |
| 6 | Isovaleraldehyde | 70.33 | 6.63 | 23.04 | 1.5 | 22.59 |
| 7 | Pentanal | 68.79 | 6.94 | 24.27 | 2.0 | 23.67 |
| 8 | Benzaldehyde | 70.22 | 5.41 | 24.37 | 1.5 | 23.92 |
| 9 | Phenylacetaldehyde | 74.63 | 5.82 | 19.55 | 3.5 | 18.50 |
| 10 | p-Tolualdehyde | 71.63 | 5.52 | 22.85 | 8.3 | 20.36 |
| 11 | Cyclohexanone | 70.85 | 6.57 | 22.58 | 1.0 | 22.28 |
| 12 | 1,3-Cyclohexanedione | 64.51 | 5.75 | 29.74 | <1.0 | 29.74 |
| 13 | 2,4-Pentanedione | 67.03 | 5.88 | 27.09 | <1.0 | 27.09 |
| 14 | 2,3-Butanedione | 65.52 | 5.82 | 28.66 | <1.0 | 28.66 |
| 15 | Acetonyl acetone | 76.40 | 7.04 | 16.56 | 3.50 | 15.51 |
| 16 | Acetone[1] | 68.06 | 6.94 | 25.00 | <1.0 | 25.00 |
| 17 | Propionaldehyde[2] | 69.39 | 7.04 | 23.57 | <1.0 | 23.57 |
| 18 | Acetone[2] | 70.84 | 7.30 | 21.86 | <1.0 | 21.86 |
| 19 | Pentan-3-one[2] | 70.50 | 7.45 | 22.05 | <1.0 | 22.05 |
| 20 | Heptan-4-one[2] | 68.85 | 6.90 | 24.25 | <1.0 | 24.25 |

See explanatory notes beneath Table 11.

TABLE 13

Outcomes of Solubility Determination for the Isolated Compositions

| Compound No. | Carbonyl Compound | Solubility at −30° C. 2.5 wt % Fe | Solubility at −30° C. 5.0 wt % Fe | Solubility of Fe as product |
|---|---|---|---|---|
| 1 | Acetone | Clear | Solids | <3.2 wt % by dilution |
| 1a | Acetone (9% oligomer) | Clear | Solids | |
| 2 | Methylal | Solids | Solids | |
| 3 | Butyraldehyde | Trace | Solids | ~2.4 wt % by mass balance |
| 4 | 2-Ethylhexanal | Clear | Clear | |
| 5 | Isobutyraldehyde | Clear | Clear | |
| 6 | Isovaleraldehyde | Clear | Powder | Insufficient solids to characterise |
| 7 | Pentanal | Clear | Clear | |
| 8 | Benzaldehyde | Trace of powder | Orange solids | Powder found to be product, so solubility ~2.4 wt % Fe |
| 9 | Phenylacetaldehyde | Clear | Clear | |
| 10 | p-Tolualdehyde | Clear | Solids | 3.8 to 4.3 wt % by mass balance |
| 11 | Cyclohexanone | Clear | Powder | ~4.9 wt % |
| 12 | 1,3-Cyclohexanedione | Clear | Crystals | 3.6 to 4.1 wt % by mass balance |
| 13 | 2,4-Pentanedione | Solids | Solids | 2.05 to 2.26 wt % by mass balance |
| 14 | 2,3-Butanedione | Clear | Clear | |
| 15 | Acetonyl acetone | Powder | Powder | Solid not characterisable |
| 16 | Acetone[1] | Sludge | Sludge | Sludge due to inorganics in sample |
| 17 | Propionaldehyde[2] | Clear | Clear | |
| 18 | Acetone[2] | Clear | Clear | |
| 19 | Pentan-3-one[2] | Deposit | Deposit | Minimal deposition in both cases |
| 20 | Heptan-4-one[2] | Clear | Solids | Insufficient solids to characterise |

For explanatory notes, see beneath Table 11.

For comparison, the solubility of iron as ferrocene in toluene was around 1 wt %. Dilutions of samples of 5 wt % Fe as the product of compound 1 established the solubility limit in toluene of this preferred material to be slightly less than 3.2 wt % at −30° C.

TABLE 14

Nmr Spectroscopy Details for Derivatives Isolated as Crystalline Materials

| Compound No. | Carbonyl signals/ Cyclopentadienyl | $^{1}H$ nmr | $^{13}C$ nmr |
|---|---|---|---|
| 3 | Butyraldehyde | 0.946 (t, 3H), 1.41 (m, 2H) 1.94 (m, 2H) 3.13 (m, 1H) | 14.53 ($CH_3$), 21.77 ($CH_2$), 37.99 (CH), 40.28 ($CH_2$) |
| | Cyclopentadienyl | 3.99 (m, 18H) | 68.78 to 95.58 |
| 8 | Benzaldehyde | 7.15 to 7.41 (m 6H) | 93.39, 145.94, 128.75 and 127.88 |
| | Cyclopentadienyl | 3.81 to 4.74 (m, 18H) | 46.68 to 68.68 |
| 13 | 2,4-Pentanedione | 1.308 (s, 6H) | 30.77 ($CH_3$), 33.47 ($CH_2$) and 101.51 ($CH_3$—C—$CH_2$) |
| | Cyclopentadienyl | 3.93 to 4.01 (m, 18H) | 66.27, 66.73 and 68.89 |

TABLE 15

GC/MS Data, where obtained

| Compund No. | Carbonyl source | Component/(level) | Comments |
|---|---|---|---|
| 4 | 2-ethylhexanal | 2-ethylhexenyl ferrocene (major) | Many isomers, parent ion 296, loss of various alkene fragments |
| | | Bis 2-ethylhexenyl ferrocene (minor) | Isomers, parent ion at 406, typically loss of heptene observed |
| | | 1,1-diferrocenyl 2-ethylhexane (trace) | Parent at 482, first loss heptene |
| 5 | Isobutyraldehyde | Mono-, bis and tris-isobutenyl ferrocene (significant) | Mixture of isomers present |
| | | 1,1-diferrocenyl-2-methyl propane (major) | Parent at 426, first loss $C_3H_7$ |
| 6 | Isovaleraldehyde | 1,1-diferrocenyl-3-methyl butane (major) | Parent at 440, first loss $C_4H_9$ |
| | | Mono-alkenylated above product (significant) | Parent at 508 |
| 7 | Pentanal | 1,1-diferrocenylpentane (good purity) | Parent at 440, first loss $C_4H_9$ |
| 8 | Benzaldehyde | Diferrocenyl phenyl methane | Desired product in good purity Parent 460, first loses $C_5H_6$ |
| 9 | Phenylacetaldehyde | 1-ferrocenyl-2-phenyl ethene (significant) | Parent 288, loses $C_5H_5$ |
| | | Di-(2-phenylethenyl) ferrocenes (significant) | Parent 390, loses $C_7H_7$ |
| | | 1,1-diferrocenyl phenyl methane (major) | Parent 474, loses $C_7H_7$ |
| 11 | Cyclohexanone | Cyclopentene, cylcohexene, cyclohexane and cyclohexanol and mixed substituted ferrocenes (traces) | |
| | | 1,1-diferrocenyl cyclohexane (major) | Parent 452, loses $C_5H_9$, $C_5H_6$ ends at methylferrocene |
| 14 | 2,3-butanedione | Ferrocene substituted by $C_4H_7O$ (apparent good purity) | Not clear if substituent is ketone or enol. |
| 21 | Methoxy-acetaldehyde dimethylacetal | 1,1'-diferrocenyl-2-methoxy ethane (major isolated product) | Unreacted ferrocene predominant |

TABLE 16

Viscosity Data of Compositions in Toluene Solution at 2.5 wt % Fe

| Compound | Carbonyl Source | Metallocene | Viscosity at −30° C. (mPas) |
|---|---|---|---|
| 1 | Acetone | Ferrocene | 5.4 |
| 1a | Acetone | Ferrocene | 5.2 |
| 4 | 2-ethylhexanal | Ferrocene | 5.1 to 6.4 |
| 7 | Pentanal | Ferrocene | 5.4 |
| 8 | Benzaldehyde | Ferrocene | 5.2 to 5.5 |
| 9 | Phenylacetaldehyde | Ferrocene | 4.3 |
| 10 | p-Tolualdehyde | Ferrocene | 5.0 |
| 11 | Cyclohexanone | Ferrocene | 4.8 |
| 13 | 2,4-Pentanedione | Ferrocene | 4.7 |
| 16 | Acetone | Methylferrocene | 6.3 |
| 17 | Propionaldehyde | Ethylferrocene | 5.3 |
| 18 | Acetone | Ethylferrocene | 5.2 |
| 19 | Pentan-3-one | Ethylferrocene | 5.3 |
| 20 | Heptan-4-one | Ethylferrocene | 5.1 |

Interpretation of Data

Compounds 1 and 1a above were prepared in order to obtain comparison data for the solubility of the preferred compound in toluene. Toluene is preferred over Plutosol APF for such experiments simply because its higher volatility enables its simpler removal from any products. The solubility of iron as the preferred product in toluene is, at around 3.2 wt %, inferior to its solubility in PLUTOSOl™ APF, known to be at least 5.0 wt % at −40° C. (see, for example, Example 1 where solutions of 2,2-bisferrocenylpropane in PLUTOsol™ APF with an iron content of 7.5% by weight were found to be stable without any problems).

Compound 2 shows that aldehyde equivalents, such as acetals, can be used in place of ketones. Whilst the product, diferrocenyl methane, provided a lower solubility of iron in toluene at −30° C. than any other derivative, its solubility was still in excess of that of ferrocene itself.

Compounds 3 and 7 show that n-aldehydes may be used to prepare very pure samples of 1,1-diferrocenyl n-alkanes. Compounds 4, 5 and 6 demonstrate that branched aldehydes may also be used to prepare 1,1-diferrocenyl alkanes. The GC/MS data for compounds 4 (in particular) and 5 also show that where an aldehyde, and by inference a ketone, is branched at the position α to the carbonyl then a propensity to form alkenyl-substituted ferrocene exists. Without wishing to be bound by theory it is suspected that an intermediate hydroxyalkyl ferrocene forms which may react with a further molecule of ferrocene to yield a diferrocenylalkyl or may dehydrate to yield the alkene. Experimental conditions may be changed by routine experimentation to minimise formation of such products. Compound 6 shows that β-branched carbonyls are significantly less prone to undergo this side reaction. U.S. Pat. No. 3,763,232 describes the use of branched ketones.

Compound 8 shows that the bridging group may be substituted by an aryl group, compound 9 that the substituent may be an aralkyl group and compound 10 an alkaryl group. Again, compound 9 shows that an α-substituted carbonyl is prone to side reaction under the standard conditions employed.

Compound 11 shows that the bridging group may be part of a cycloaliphatic group.

Compounds 12 through 15 are for dicarbonyl compounds. It is believed that these form species of formula I wherein n in formula III is zero and Z is substituted by two groups of formula V in which m is zero. Unless such compounds are formed in exceptionally high purity and/or are readily crystallised it is difficult to demonstrate that such species have, indeed been formed. The formula weight of the species expected in compound 13, for example, is 808 Daltons. Such a species would not be expected to possess the combined volatility and thermal stability to pass through the GC and is beyond the mass limits of the mass spectrometer employed. In all four cases the existence of side products comprising alkyl-, alkenyl-, cycloalkyl- and cylcloalkenyl-substituted ferrocene and some diferrocene products could be inferred from the GC/MS trace. It is not clear that these arise during the synthesis or on pyrolysis in the GC oven. The $^{1}H$ and $^{13}C$ spectra for the crystalline solids isolated during the low temperature solubility study on compound 13 show that substantial amounts of a highly symmetrical material containing equivalent methyl and cyclopentadienyl groups and by implication no carbonyl or hydroxyl groups are present or have been formed. It is not clear whether the methylene protons are not present or are (more likely) accidentally degenerate with the cyclopentadienyl ones.

Compound 16 shows that the reaction conditions may be employed with alkyl-substituted ferrocene. The formation of a viscous oil as product indicates that there is either or both of a low selectivity for the reaction of the carbonyl compound between alkylated or non-alkylated cyclopentadienyl groups or for orientation relative to the alkyl group.

Compounds 17 through 20 show that the reaction conditions are not sensitive to the location of the carbonyl group within a hydrocarbon. 1,1'-, 2,2'-, 3,3'- and 4,4'-diferrocenylalkanes are thus demonstrated.

Compound 21 shows that it is possible for the bridging group to contain substituents containing heteroatoms, in this case oxygen. The solubility in heptane of this particular product is, unlike the other compounds, very similar to that of ferrocene. Further, the product is a solid melting at above 80° C. and so difficult to separate from a mixture with ferrocene using the sublimation technique. Accordingly, characterisation was limited to the GC/MS technique which showed the desired material to be the dominant reaction product, even under the standardised reaction conditions.

All publications mentioned in the above specification are herein incorporated by reference. Various modifications and variations of the described methods and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in chemistry or related fields are intended to be within the scope of the following claims.

The invention claimed is:

1. A composition, which comprises:

i) one or more compound of formula (I):

$$X—Y \quad (I)$$

where:

X represents the group of formula (II):

$$\begin{array}{c} A \\ | \\ Fe\text{----}Z\text{----} \\ | \\ B \end{array} ; \quad (II)$$

Y represents the group of formula (III):

(III)

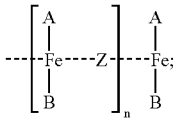

one of A and B is an unsubstituted 3-membered aromatic carbon ring and the other of A or B is an unsubstituted 7-membered aromatic carbon;

the or each Z is independently an unsubstituted or substituted divalent hydrocarbyl group;

n is 0 or an integer of from 1 to 10; and ii) a diluent or carrier; and wherein said one or more compound of formula (I) is present in an amount sufficient to provide at least 1 wt. % of iron, based on the weight of the composition.

2. A method of regenerating a particle filter trap located in the exhaust system of a combustion system for fuel, which comprises contacting carbon-based particulates, present in the particle filter trap, with combustion products.

having a composition which comprises:

i) one or more compound of formula (I):

X—Y (I)

where:

X represents the group of formula (II):

(II)

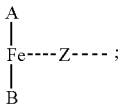

Y represents the group of formula (III):

(III)

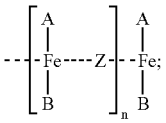

each A and B is an unsubstituted aromatic carbon ring;

the or each Z is independently an unsubstituted or substituted divalent hydrocarbyl group;

n is 0 or an integer of from 1 to 10; and ii) a diluent or carrier; and wherein said one or more compound of formula (I) is present in an amount sufficient to provide at least 1 wt. % of iron, based on the weight of the composition.

3. A method as claimed in claim 2, wherein the composition is located in a container associated with the combustion system for introduction into fuel prior to combustion of the fuel in the combustion system.

4. A method for decreasing the regeneration temperature of a particle filter trap located in the exhaust system of a combustion system comprising adding to fuel for said combustion system a composition comprising i) one or more compound of formula (I):

X—Y (I)

where:

X represents the group of formula (II):

(II)

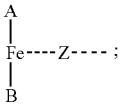

Y represents the group of formula (III):

(III)

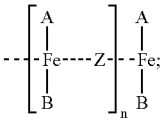

each A and B is an unsubstituted aromatic carbon ring;

the or each Z is independently an unsubstituted or substituted divalent hydrocarbyl group;

n is 0 or an integer of from 1 to 10; and ii) a diluent or carrier; and wherein said one or more compound of formula (I) is present in an amount sufficient to provide at least 1 wt. % of iron, based on the weight of the composition.

5. A method of regenerating a particle filter trap located in the exhaust system of a combustion system for fuel, which comprises contacting carbon-based particulates, present in the particle filter trap, with combustion products of one or more compound which comprises:

i) one or more compound of formula (I):

X—Y (I)

where:

X represents the group of formula (II):

(II)

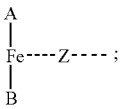

Y represents the group of formula (III):

(III)

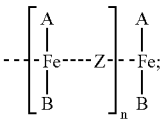

each A and B is an unsubstituted aromatic carbon ring;

the or each Z is independently an unsubstituted or substituted divalent hydrocarbyl group;

n is 0 or an integer of from 1 to 10; and ii) a diluent or carrier; and wherein said one or more compound of formula (I) is present in an amount sufficient to provide at least 1 wt. % of iron, based on the weight of the composition.

6. The method of claim 5 wherein said compound comprises: a geminal bisferrocenylalkane.

7. A method as claimed in claim 6, wherein one or more of the four cyclopentadienyl rings of the geminal bisferrocenylalkane independently of one another carry at least one alkyl group with 1 to 4 carbon atoms as a substituent.

8. A method as claimed in claim 6, wherein the geminal bisferrocenylalkane is dissolved in an organic solvent.

9. A method of regenerating a particle filter trap located in the exhaust system of a combustion system for fuel, which comprises contacting carbon-based particulates, present in the particle filter trap, with combustion products of a composition comprising:

i) one or more compound of formula (I):

X—Y (I)

where:

X represents the group of formula (II):

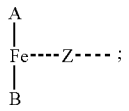

(II)

Y represents the group of formula (III):

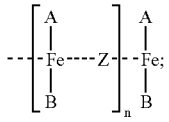

(III)

each A and B is independently an unsubstituted or substituted aromatic carbon ring or an unsubstituted or substituted aromatic heterocyclic ring;

the or each Z is independently an unsubstituted or substituted divalent hydrocarbyl group;

n is 0 or an integer of from 1 to 10; and ii) a diluent or carrier; and wherein said one or more compound of formula (I) is present in an amount sufficient to provide at least 1 wt. % of iron, based on the weight of the composition.

10. A method as claimed in claim 9, wherein the composition is located in a container associated with the combustion system for introduction into fuel prior to combustion of the fuel in the combustion system.

11. A method as claimed in claim 9, wherein Z, when n is 0, or one or more of the Z groups, when n is from 1 to 10, is an unsubstituted or substituted divalent hydrocarbon group.

12. A method as claimed in claim 11, wherein Z, when n is 0, or one or more of the Z groups, when n is from 1 to 10, is an unsubstituted or substituted divalent alkylene group having at least one carbon atom in the alkylene linkage.

13. A method as claimed in claim 12, wherein Z, when n is 0, or one or more of the Z groups, when n is from 1 to 10, is an unsubstituted or substituted divalent alkylene group having from 1 to 10 carbon atoms in the alkylene linkage.

14. A method as claimed in claim 13, wherein Z, when n is 0, or one or more of the Z groups, when n is from 1 to 10, is an unsubstituted or substituted divalent alkylene group having at least two carbon atoms in the alkylene linkage.

15. A method as claimed in claim 13, wherein Z, when n is 0, or one or more of the Z groups, when n is from 1 to 10, is an unsubstituted or substituted divalent alkylene group having one carbon atom in the alkylene linkage.

16. A method as claimed in claim 9, wherein Z, when n is 0, or one or more of the Z groups, when n is from 1 to 10, is substituted with one or more substituents selected from alkyl groups, substituted alkyl groups and groups having the formula (V)

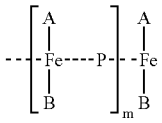

(V)

wherein:

each A and B is independently an unsubstituted or substituted aromatic carbon ring or an unsubstituted or substituted aromatic heterocyclic ring;

each P, when present, is independently an unsubstituted or substituted hydrocarbyl group; and m is 0 or an integer of from 1 to 10.

17. A method as claimed in claim 9, wherein Z, when n is 0, or one or more of the Z groups, when n is from 1 to 10, is:

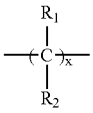

(VI)

wherein:

each $R_1$ and $R_2$ is independently hydrogen, or unsubstituted or substituted alkyl, unsubstituted or substituted aryl or unsubstituted or substituted aralkyl; and x is an integer of at least 1.

18. A method as claimed in claim 17, wherein $R_1$ and $R_2$ are each independently hydrogen, or unsubstituted or substituted $(C_1\text{-}C_6)$alkyl, unsubstituted or substituted $(C_6)$aryl or unsubstituted or substituted ar$(C_1\text{-}C_6)$alkyl.

19. A method as claimed in claim 17, wherein x is an integer of from 1 to 10.

20. A method as claimed in claim 17, wherein x is an integer of at least 2.

21. A method as claimed in claim 17, wherein x is 1.

22. A method as claimed in claim 17, wherein $R_1$ and $R_2$ are methyl.

23. A method as claimed in claim 9, wherein one or more of A and/or one or more of B is substituted with one or more substituents selected from, alkyl, substituted alkyl, aryl, and substituted aryl groups.

24. A method as claimed in claim 9, wherein each A and B is independently an unsubstituted or substituted aromatic carbon ring or an unsubstituted or substituted aromatic heterocyclic ring containing, in the heterocyclic ring, one or more heteroatoms selected from O, N and S.

25. A method as claimed in claim 9, wherein each A and B is independently an unsubstituted or substituted aromatic carbon ring, or an unsubstituted or substituted aromatic heterocyclic ring, containing from 3 to 10 atoms in the ring.

26. A method as claimed in claim 25, wherein each A and B is independently an unsubstituted or substituted aromatic carbon ring, or an unsubstituted or substituted aromatic heterocyclic ring, containing 3, 5 or 7 atoms in the ring.

27. A method as claimed in claim 26, wherein A or B is an unsubstituted or substituted 3-membered aromatic carbon ring or an unsubstituted or substituted 3-membered aromatic heterocyclic ring, and the other of A or B is an unsubstituted or substituted 7-membered aromatic carbon ring or an unsubstituted or substituted 7-membered aromatic heterocyclic ring.

28. A method as claimed in claim 26, wherein, each A and B group is an unsubstituted or substituted aromatic carbon ring, or an unsubstituted or substituted aromatic heterocyclic ring, containing 5 atoms in the ring.

29. A method as claimed in claim 28, wherein each A and B is an unsubstituted aromatic carbon ring, or an unsubstituted aromatic heterocyclic ring, containing 5 atoms in the ring.

30. A method as claimed in claim 9, wherein each A and B is independently an unsubstituted or substituted aromatic carbon ring.

31. A method as claimed in claim 30, wherein each A and B is an unsubstituted aromatic carbon ring.

32. A method as claimed in claim 9, wherein A and B are the same.

33. A method as claimed in claim 9, wherein A and B are both cyclopentadienyl.

34. A method as claimed in claim 9, wherein the compound of formula (I) has the formula (VII):

(VII)

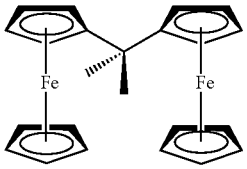

35. A method as claimed in claim 9, wherein the compound of formula (I) is present in an amount sufficient to provide at least 2 wt. % of iron, based on the weight of the composition.

36. A method as claimed in claim 35, wherein the compound of formula (I) is present in an amount sufficient to provide at least 3 wt. % of iron, based on the weight of the composition.

37. A method as claimed in claim 9, wherein the compound of formula (I) is present in an amount sufficient to provide, at −40° C., at least 1 wt. % of iron, based on the weight of the composition.

38. A method as claimed in claim 9, which is substantially free of compounds of formula (VIII):

A—Fe—B (VIII)

wherein A and B are as defined in claim 9.

39. A method for decreasing the regeneration temperature of a particle filter trap located in the exhaust system of a combustion system comprising adding a composition to fuel for said combustion system, said composition comprising:

i) one or more compound of formula (I):

X—Y (I)

where:

X represents the group of formula (II):

(II)

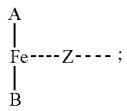

Y represents the group of formula (III):

(III)

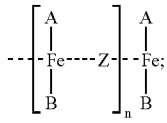

each A and B is independently an unsubstituted or substituted aromatic carbon ring or an unsubstituted or substituted aromatic heterocyclic ring;

the or each Z is independently an unsubstituted or substituted divalent hydrocarbyl group;

n is 0 or an integer of from 1 to 10; and ii) a diluent or carrier; and wherein said one or more compound of formula (I) is present in an amount sufficient to provide at least 1 wt. % of iron, based on the weight of the composition.

* * * * *